US006394909B1

(12) United States Patent
Laibangyang

(10) Patent No.: US 6,394,909 B1
(45) **Date of Patent: *May 28, 2002**

(54) GOLF CLUB WITH FIXED-TENSION SHAFT

(76) Inventor: Charnnarong Laibangyang, 1066 Hillside St., Monterey Park, CA (US) 91754

( * ) Notice: Subject to any disclaimer, the term of this patent is extended or adjusted under 35 U.S.C. 154(b) by 0 days.

This patent is subject to a terminal disclaimer.

(21) Appl. No.: 09/703,032

(22) Filed: Oct. 31, 2000

Related U.S. Application Data

(63) Continuation-in-part of application No. 09/553,594, filed on Apr. 20, 2000, now Pat. No. 6,241,623.

(60) Provisional application No. 60/170,772, filed on Dec. 15, 1999.

(51) Int. Cl.[7] ..... A63B 69/36

(52) U.S. Cl. ..... 473/232; 473/238; 473/289; 473/316; 473/318

(58) Field of Search ..... 473/316, 317, 473/318, 319, 320, 321, 322, 323, 282, 289, 219, 231, 300, 23, 223, 233, 226, 227, 256, 520, 238, 549, 516, 524, 560, 564; 43/18.1

(56) References Cited

U.S. PATENT DOCUMENTS 1,590,469 A * 6/1926 Marsh
2,351,734 A * 6/1944 Backe
2,478,131 A * 8/1949 Rossi
2,801,106 A * 7/1957 Koehler
2,816,389 A * 12/1957 Sens
2,992,828 A 7/1961 Stewart
3,318,602 A * 5/1967 Kunisha
3,833,223 A * 9/1974 Shulkin
4,024,666 A * 5/1977 Carver
4,214,395 A * 7/1980 Caldwell
4,685,682 A 8/1987 Isabell
5,226,652 A * 7/1993 Satro
5,865,688 A 2/1999 Bae
5,931,744 A 8/1999 Hackman
6,045,457 A * 4/2000 Soong
6,231,456 B1 * 5/2001 Rennie
6,241,623 B1 * 6/2001 Laibangyang
6,257,997 B1 * 7/2001 Doble et al.

FOREIGN PATENT DOCUMENTS

JP 03 193069 A 8/1991
WO WO 01/27244 A1 4/2001

* cited by examiner

*Primary Examiner*—Sebastiano Passaniti
(74) *Attorney, Agent, or Firm*—Edward Gray

(57) ABSTRACT

A golf club having a hollow shaft whose flexibility is determined by the tension on a wire coinciding with the shaft longitudinal axis. The is attached between a fixed assembly in the handle and a fixed assembly at the shaft lower end. The upper assembly includes a cap member, a wire-end clamping member, and a tension support member. A first embodiment uses a thin round wire. A second embodiment uses a thin tape-shaped wire.

10 Claims, 6 Drawing Sheets

10,100
7,13
14
12
16
16B
7,13
20
22
26
3,9
3,9

10
32U
14
20E
34
16
12
18
16A
16B
28A
20
28B
32
28C
22
28D
28E
26
28F
36
24
32L
26E 40
36
42
44
32L
46

30
32
26
30
26W
26E
36
42
32L

GOLF CLUB WITH FIXED-TENSION SHAFT

CROSS-REFERENCE TO RELATED APPLICATIONS

This application is a continuation-in-part of application Ser. No. 09/553,594 filed Apr. 20, 2000, entitled "Golf Club With Adjustably Flexible Shaft," now U.S. Pat. No. 6,241,623, which claimed benefit of priority of provisional patent application Ser. No. 60/170,772, entitled "Adjustable Flexibility Golf Club Shaft," filed on Dec. 15, 1999. application Ser. No. 09/553,594 is incorporated herein in its entirety by this reference.

BACKGROUND OF THE INVENTION

1. Field of the Invention

This invention relates to golf clubs, and more particularly to a wood or iron having a shaft whose flexibility is predetermined during manufacture by tensioning a wire internal to the shaft and extending along its length.

2. Description of the Related Art

Application Ser. No. 09/553,594 is directed to a golf club having a hollow shaft whose flexibility can be altered by changing the tension on a wire coinciding with the shaft longitudinal axis. The wire is attached between a longitudinally movable assembly in the club handle and a fixed assembly at the shaft lower end. By rotating the handle, a golfer can determine through experimental trial which degree of flexibility best suits his or her particular full range of motion swing. The movable assembly, which includes outer and inner tension tuner members, a collar, a clamp and bifurcated collet, and outer and inner twist-prevention housings, is a complex mechanism built to close tolerances whose manufacturing cost is reflected in a relatively high sale price likely to discourage some potential buyers. To broaden market appeal there is a need for a simpler and therefore cheaper device which, while not offering a continuous range of shaft flexibility adjustment, allows a buyer to select a club whose shaft has been pretensioned at the factory to that flexibility best suited for that individual.

OBJECTS OF THE INVENTION

It is therefore an object of the present invention to provide a golf club incorporating a device which during manufacture allows the club shaft to be tuned to a preselected flexibility.

Another object of the invention is to provide a club whose shaft flexibility is preselectable during manufacture over a range of flexibilities.

A further object of the invention is to provide a club whose shaft imparts kinetic energy to the clubhead additional to that generated in the downswing of a conventional club.

Yet another object of the invention is to provide a device to tune shaft flexibility which is inexpensive to manufacture and readily adaptable to any club having a hollow shaft and clubhead.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a golf club including a handle with a cavity having upper and lower portions, and a hollow shaft upper portion terminating in an upper end received within the cavity lower portion and symmetric about a longitudinal axis. The club further includes a hollow flexible shaft central portion, symmetric about the axis, attached at an upper end to the shaft upper portion and attached at a lower end to a hollow shaft lower portion, symmetric about the axis, which terminates in a lower end. The club further includes a cap member having an inner thread, and an outer surface received within the handle cavity upper portion. The club further includes a wire-end clamping member having a longitudinal bore and opposed planar upper and lower ends. The clamping member is radially compressible, and the cap member is superposed upon the compressed clamping member. The club further includes a tension support member having a cylindrical lower portion received within the shaft upper portion, a cylindrical upper portion having an outer thread, and an annular flange having opposed planar upper and lower surfaces. The flange is disposed between and attached to the support member upper and lower portions, and the flange lower surface contacts the upper end of the shaft upper portion. The cap member inner thread is in threaded combination with the outer thread of the upper portion. The club further includes a metallic wire, disposed along the axis and maintained at a constant tension, having opposed upper and lower wire-ends. The upper wire-end is maintained within the clamping member, and the lower wire-end is attached to the shaft portion lower end.

In another aspect the invention provides a golf club including a handle having a cap portion attached to a grip portion having a cylindrical interior surface and a scallop-contoured, downwardly tapering exterior surface. The cap portion and interior surface determine a cylindrical cavity having upper and lower portions. The club further includes a hollow downwardly tapering shaft upper portion terminating in an upper end received within the cavity lower portion and symmetric about a longitudinal axis, a hollow flexible, downwardly tapering shaft central portion, symmetric about the axis, which is attached at an upper end to the shaft upper portion and attached at a lower end to a hollow shaft lower portion, symmetric about the axis, having an inner wall and terminating in a lower end. The club further includes an upper wire-end retainer assembly including a cap member having a top portion, an inner thread, and a cylindrical outer surface received within the handle cavity upper portion. The retainer assembly further includes a radially compressible, hexagonal-shaped wire-end clamping member having opposed upper and, lower ends, an outer surface, and a constant cross-section longitudinal bore therethrough. The cap member is superposed upon the clamping member after it is compressed. The retainer assembly further includes a tension support member having a cylindrical lower portion received within the shaft upper portion, a cylindrical upper portion having an outer thread, and an annular flange having opposed upper and lower surfaces. The flange is disposed between and attached to the upper and lower portions, and the flange lower surface contacts the upper end of the shaft upper portion. The cap member inner thread is in threaded combination with the outer thread of the tension support member upper portion. The club further includes a lower wire-end retainer assembly including a cylindrical sleeve extending in a cylindrical flange. The sleeve and flange have therethrough a common bore, and a ring is received within the flange. The flange is attached to the inner wall of the shaft lower portion at its lower end. The club further includes a constant cross-section metallic wire having opposed upper and lower wire-ends and disposed along the longitudinal axis. The upper wire-end is closely received within the bore of the wire-end clamping member and is secured therein after the clamping member is radially compressed. The lower wire-end is attached to the ring of the lower wire-end retainer. The wire has a constant preselected tension.

A more complete understanding of the present invention and other objects, aspects and advantages thereof will be gained from a consideration of the following description of the preferred embodiments read in conjunction with the accompanying drawings provided herein.

DESCRIPTION OF THE PREFERRED EMBODIMENTS

Figures 1, 2, 3, 4:
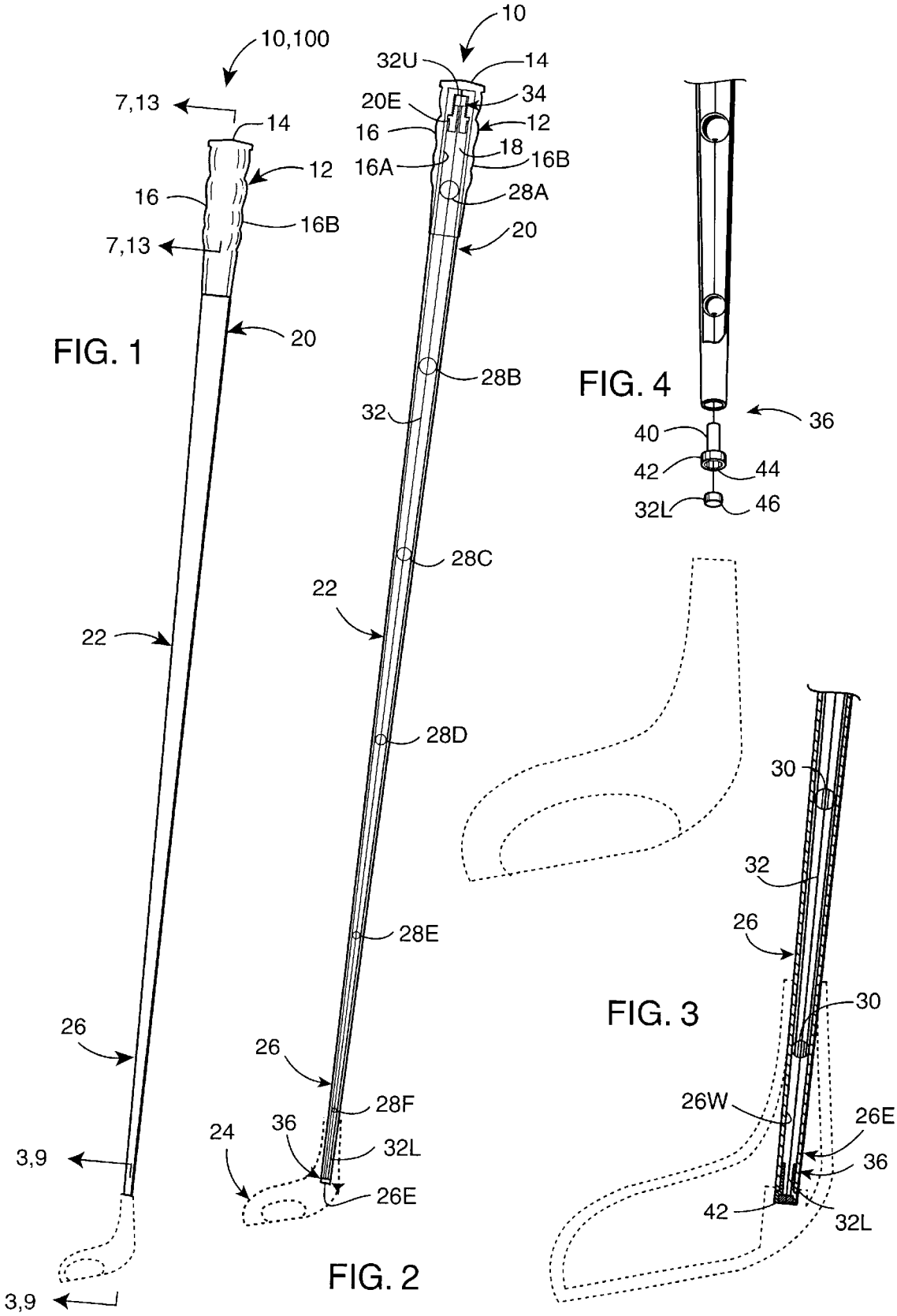
FIG. 1 is a perspective view of a golf club with a hollow shaft and clubhead according to first and second embodiments of the invention.
FIG. 2 is a longitudinal sectional view of the FIG. 1 club according to the first embodiment showing a fixed upper wire-end retainer assembly, a fixed lower wire-end retainer assembly, and a thin, round tension wire along the shaft longitudinal axis passing through and centered by six wire support members and clamped between the two assemblies.
FIG. 3 is a greatly enlarged sectional view taken along line 3—3 in FIG. 1 showing the FIG. 2 lower wire-end retainer assembly including a flanged sleeve and a ring, and the wire lower portion and the two lowermost support members.
FIG. 4 is an exploded perspective view of the FIGS. 2, 3 lower wire-end retainer assembly, and a partial sectional view of the shaft lower portion.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

Where used herein, the word "connected" means that the two parts referred to (e.g., mated outer and inner threads) can be, readily separated after being joined together in an interlocking combination. Where used herein, the words "attached" and "attaching" mean that the two parts referred to are either fabricated in a single piece, or glued, clamped or crimped together. However, other forms of attachment may be suitable, consistent with simplicity of manufacture and reliability of operation.

Figure 5:
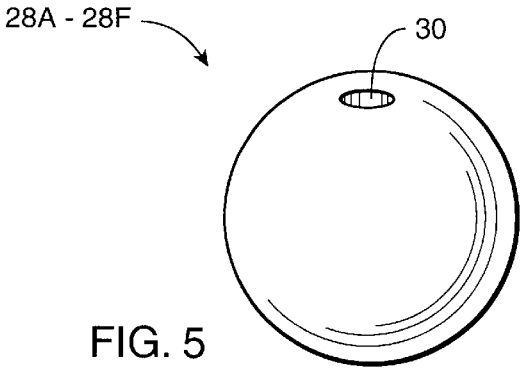
FIG. 5 is a perspective view of a wire support member according to the first embodiment.

Referring to FIGS. 1, 2, 6, and 7, a first embodiment of a golf club 10 according to the invention includes a handle 12 including a cap portion 14 and a grip portion 16 having a generally cylindrical interior surface 16A and a scallop-contoured, symmetrically downwardly tapering exterior surface 16B, the interior surface and cap portion determining a generally cylindrical cavity 18 having an upper portion 18U and a lower portion 18L. Club 10 further includes a hollow inflexible, downwardly tapering shaft upper portion 20 which terminates in an upper end 20E closely received within cavity lower portion 18L, a hollow flexible, downwardly tapering shaft central portion 22, a hollow clubhead 24 (not part of the invention) having a generally planar clubface, and a hollow inflexible shaft lower portion 26 extending into and rigidly attached at an end 26E to the clubhead. The handle and shaft upper, central and lower portions are symmetric about a common longitudinal axis. Cap portion 14 and grip portion 16 are conventionally made of a vulcanized rubber. Disposed along and within the shaft upper, central and lower portions is a plurality of wire support members 28A, 28B, 28C, 28D, 28E, 28F, progressively downwardly smaller in size, each of which is generally spherical and has therethrough a diametral circular bore 30 (see. FIG. 5). Preferably, the number of support members is six, alternatively five or seven members can be used. Alternatively, the members can be conical frustums sized to match the shaft's internal taper. The support members are fabricated from a low friction coefficient material such as a synthetic resinous fluorine-containing polymer or a polyvinyl chloride (PVC) and are rigidly attached to the shaft upper, central and lower portions, preferably adhesively, with each bore aligned along the longitudinal axis.

Figure 7:
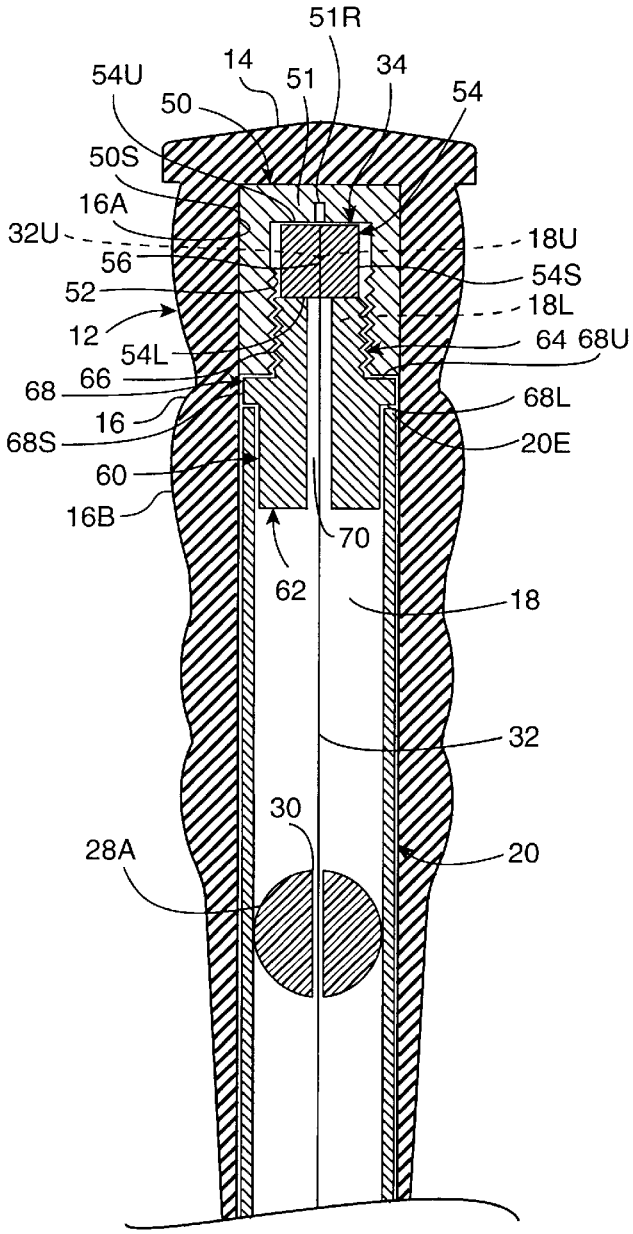
FIG. 7 is a greatly enlarged sectional view taken along line 7—7 in FIG. 1 showing the upper wire-end retainer assembly.

Referring to. FIG. 2, a thin tension wire 32 having a circular cross-section is attached at opposed upper and lower ends 32U, 32L to, respectively, an upper wire-end retainer assembly 34 closely received within the cavity 18, and a lower wire-end retainer assembly 36 closely received within and rigidly attached to the shaft lower portion end 26E. As best shown in FIGS. 3 and 7, wire 32 is threaded through each bore 30 so that the wire is constrained to be disposed along the longitudinal axis. Each bore is sized to closely receive but not frictionally interfere with the wire. Preferably, the wire is made from a stainless steel, titanium, or spring-wire having a Rockwell hardness in a range 30–70, and has a constant diameter in a range from 0.032- to 0.090-inch. Alternatively, the wire is made from a carbon steel having a Rockwell hardness in a range 30–75 with a constant diameter in a range from 0.025- to 0.090-inch, or from tungsten having a Rockwell hardness in the range 75–80 with a constant diameter in a range from 0.031- to 0.055-inch.

Referring to FIGS. 3 and 4, lower wire-end retainer assembly 36 includes a generally cylindrical sleeve 40 extending in a generally cylindrical flange 42, the sleeve and flange having therethrough a common bore 44. A generally circular ring 46 is closely received within the flange. After inserting wire-end 32L through the sleeve and into the ring and flange, the wire-end is rigidly attached to the retainer assembly by crimping the ring which, with the wire under tension, is disposed within the flange and constrained upwardly by the relatively narrow diameter sleeve. Flange 42 is rigidly attached to inner wall 26W of lower shaft portion 26 at end 26E, thereby providing additional structural integrity to the shaft-clubhead juncture.

Figure 6:
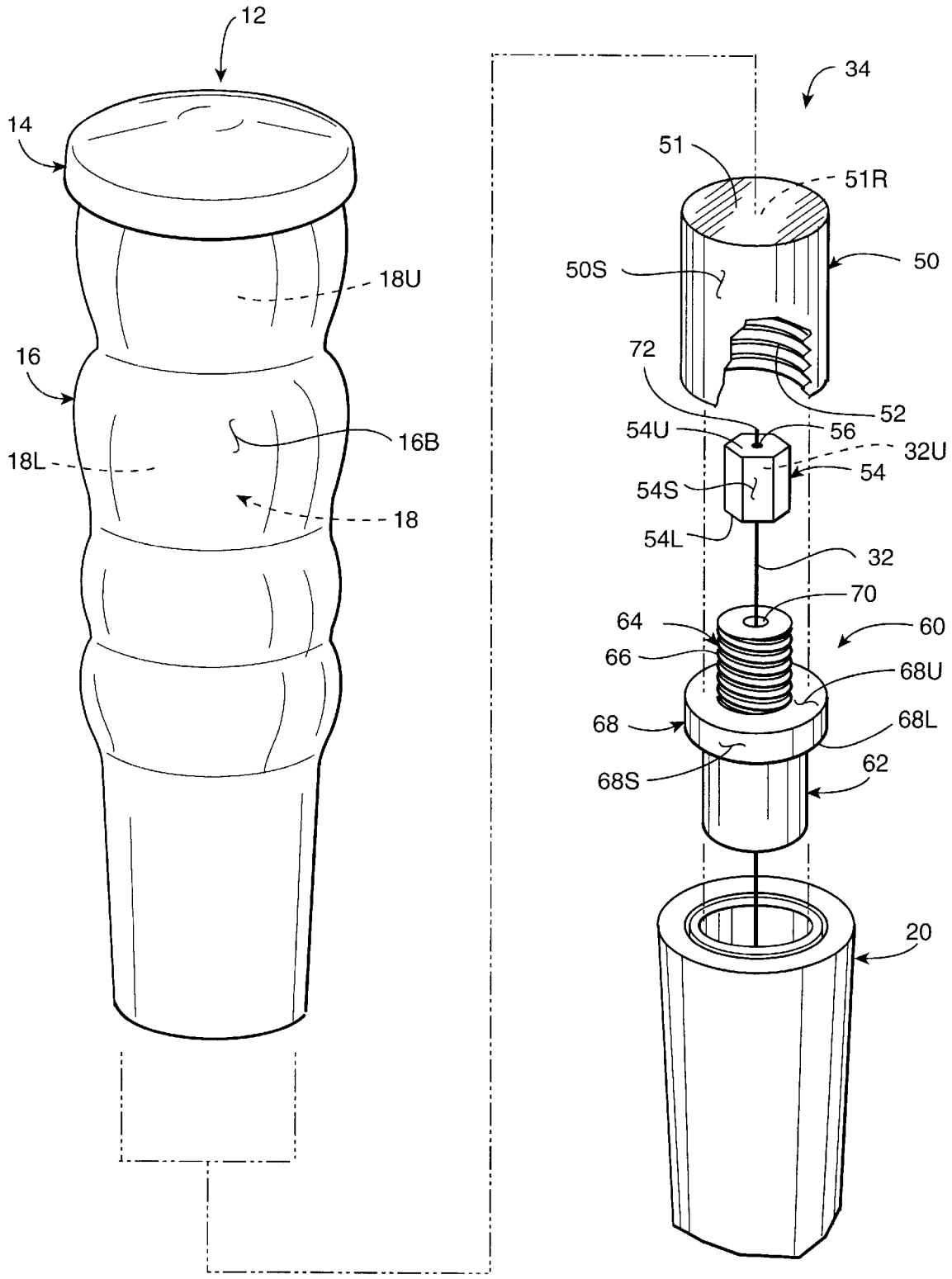
FIG. 6 is an exploded perspective and partial sectional view of the FIG. 1 club handle and FIG. 2 upper wire-end retainer assembly. The assembly includes a cap member, a wire-end clamping member, and a tension support member having a cylindrical lower portion received within the shaft, an upper threaded portion, and a flange disposed between the lower and upper portions.

Referring to FIGS. 6 and 7, the upper wire-end retainer assembly 34 includes a cap member 50 having a top portion 51 with a central inner recess 51R, an inner thread 52, and a generally cylindrical outer surface 50S, and a hexagonal-shaped wire-end clamping member 54 having opposed generally planar upper and lower ends 54U, 54L, respectively, and an outer surface 54S, and a longitudinal circular bore 56 therethrough whose diameter is initially slightly larger than the diameter of wire 32. Member 54 is fabricated from a compressible material such as stainless steel, brass, copper, titanium, tungsten, or a plastic such as a PVC. Assembly 34 further includes a tension support member 60 having a cylindrical lower portion 62 closely received within shaft upper portion 20, a generally cylindrical upper portion 64 having an outer thread 66, and an annular flange 68 with opposed generally planar upper and lower surfaces 68U, 68L, respectively, and a generally circular perimeter surface 68S, the flange. 68 attached to and disposed between lower portion 62 and upper portion 64. Portions 62 64 and flange 68 each have therethrough a circular bore 70 whose axis is along the longitudinal axis. Preferably, member 60 is machined from a single piece of stainless steel, nickel or brass. Alternatively, portions 62, 64 and flange 68 may be fabricated separately and then adhesively attached or welded together. After first attaching wire-end 32L to retainer assembly 36, wire-end 32U is rigidly attached to assembly 34 by positioning clamping member 54 on top of upper portion 64 after tension support member lower portion 62 is inserted into shaft upper portion 20, threading wire-end 32U through bore 56 so that a tip 72 protrudes, applying a predetermined longitudinal tensile force at tip 72 to create a desired tension in the wire, and then radially compressing member 54 thereby shrinking bore 56 so that wire-end 32U is tightly secured within member 54. Cap member 50 is then connected to upper portion 64 by engaging threads 52 and 66, the tip 72 being received within recess 51R.

Because wire 32 is under tension, the shaft central portion 22 flexes more during the backswing than it otherwise would, storing additional potential energy as the top of the swing is reached. During the downswing this energy is converted into kinetic energy, a process analogous to releasing a bow-string to propel an arrow. This kinetic energy is imparted to the clubhead, resulting in a more powerful impact, compared to using a conventional club, as the clubhead contacts the ball. The amount of tension in wire 32 is selected to be in a range from about 30 pounds-weight ("pounds") to about 400 pounds. Preferably, the wire tension in a highly flexible shaft is about 400 pounds, the tension for a shaft which is neither very flexible nor very stiff is about 175 pounds, and the tension for a shaft which has a stiff action is about 30 pounds.

Figure 11:
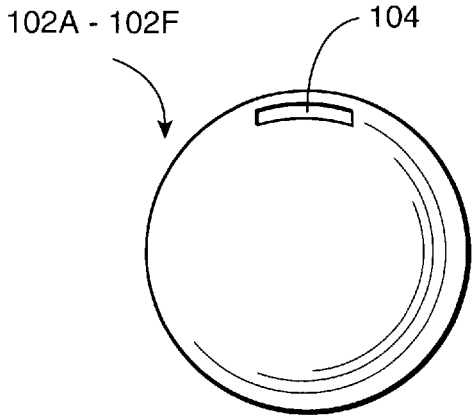
FIG. 11 is a perspective view of a wire support member according to the second embodiment.

Because the two embodiments of the invention are very similar, the following description of the second embodiment uses the same numeric indicium as in the first embodiment description where a second embodiment element is identical to a first embodiment element. Referring to FIGS. 1, 8, 12, and 13, a second embodiment of a golf club 100 according to the invention includes a handle 12 including a cap portion 14 and a grip portion 16 having a generally cylindrical interior surface 16A and a scallop-contoured, symmetrically downwardly tapering exterior surface 16B, the interior surface and cap portion determining a generally cylindrical cavity 18 having an upper portion 18U and a lower portion 18L. Club 100 further includes a hollow inflexible, downwardly tapering shaft upper portion 20 which terminates in an upper end 20E closely received within cavity lower portion 18L, a hollow flexible, downwardly tapering shaft central portion 22, a hollow clubhead 24 (not part of the invention) having a generally planar clubface, and a hollow inflexible shaft lower portion 26 extending into and rigidly attached at an end 26E to the clubhead. The handle and shaft upper, central and lower portions are symmetric about a common longitudinal axis. Cap portion 14 and grip portion 16 are conventionally made of a vulcanized rubber. Disposed along and within the shaft upper, central and lower portions is a plurality of wire support members 102A, 102B, 102C, 102D, 102E, 102F, progressively downwardly smaller in size, each of which is generally spherical and has therethrough a diametral slot-shaped bore 104 (see FIG. 11). Preferably, the number of support members is six; alternatively, five or seven members can be used. Alternatively, the members can be conical frustums sized to match the shaft's internal taper. The support members are fabricated from a low friction coefficient material such as a synthetic resinous fluorine-containing polymer or a polyvinyl chloride (PVC) and are rigidly attached to the shaft upper, central and lower portions, preferably adhesively, with each bore aligned along the longitudinal axis and the slots aligned in a plane parallel to the plane of the clubface.

Figure 8:
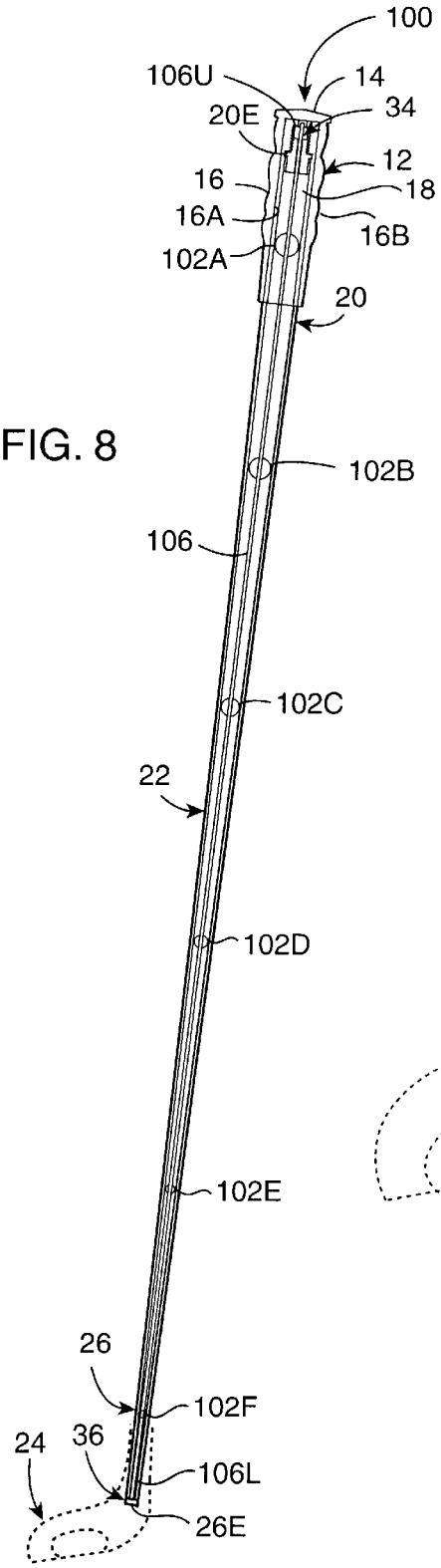
FIG. 8 is a longitudinal sectional view of the FIG. 1 club according to the second embodiment showing the FIGS. 2, 6 fixed upper wire-end retainer assembly, the FIGS. 2, 3, 4 fixed lower wire-end retainer assembly, and a thin, flat tension wire along the shaft longitudinal axis passing through and centered by six wire support members and clamped between the two assemblies.
Figure 9:
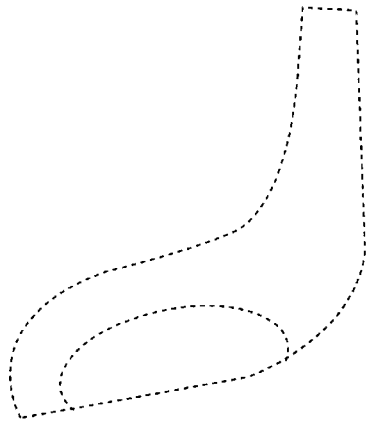
FIG. 9 is a greatly enlarged sectional view taken along line 9—9 in FIG. 1 showing the FIG. 8 lower wire-end retainer assembly including a flanged sleeve and a ring, and the wire lower portion and the two lowermost support members.
Figure 9:
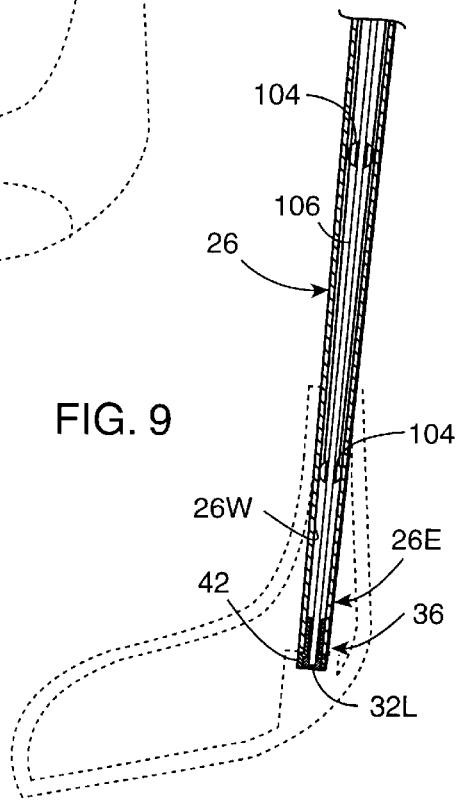
Figure 13:
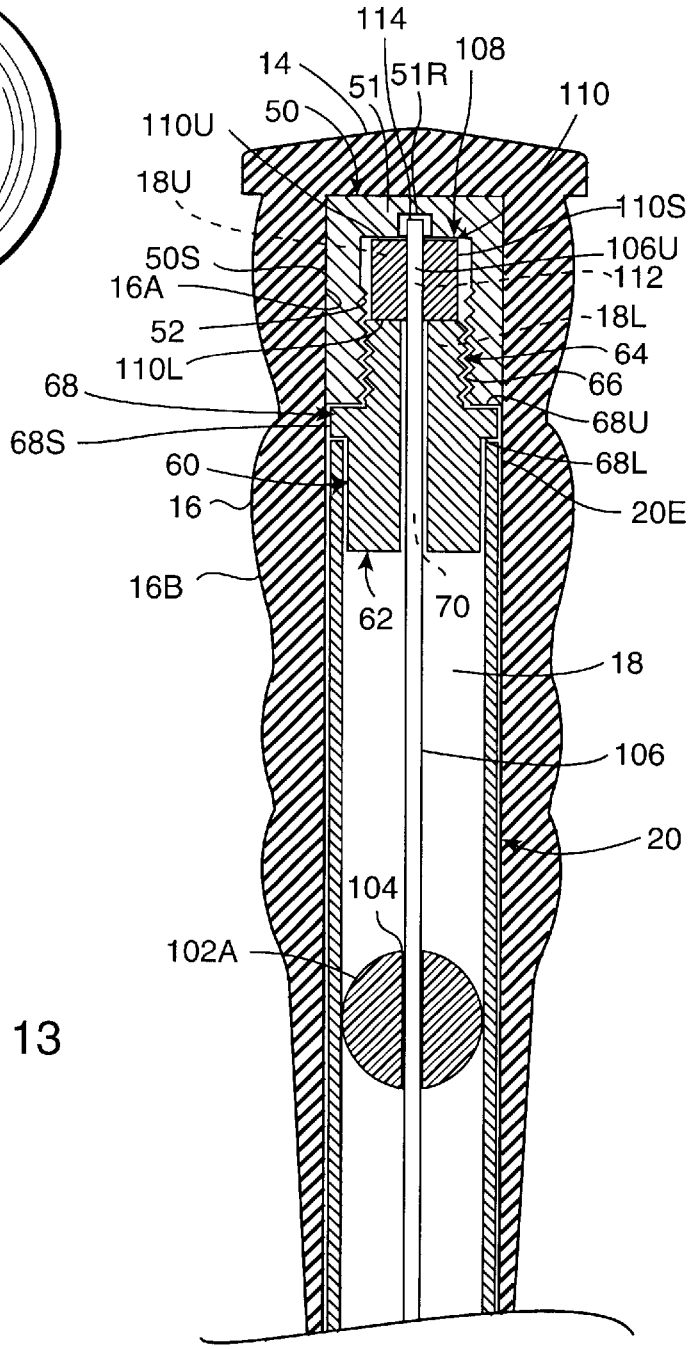
FIG. 13 is a greatly enlarged: sectional view taken along line 13—13 in FIG. 1 showing the upper wire-end retainer assembly.

Referring to FIG. 8, a thin, flat tape-shaped tension wire 106 having a rectangular cross-section is attached at opposed upper and lower ends 106U, 106L to, respectively, an upper wire-end retainer assembly 108 closely received within the cavity 18, and a lower wire-end retainer assembly 36 closely received within and rigidly attached to the shaft lower portion end 26E. As best shown in FIGS. 9 and 13, wire 106 is threaded through each bore 104 so that the wire is constrained to be disposed along the longitudinal axis and oriented so that its width dimension is in a plane through the axis and parallel to the clubface. Each bore is sized to closely receive but not frictionally interfere with the wire. Preferably, the wire is made from a stainless steel, carbon steel, titanium, or spring-wire having a Rockwell hardness in the range 30–70, and has a constant width in a range from about 0.032- to about 0.125-inch, and a constant thickness in a range from about 0.005- to about 0.025-inch. Alternatively, the wire is made from tungsten having a Rockwell hardness in a range 40–80, and has a constant width in a range from about 0.032- to about 0.125-inch, and a constant thickness in a range from about 0.005- to about 0.025-inch.

Figure 10:
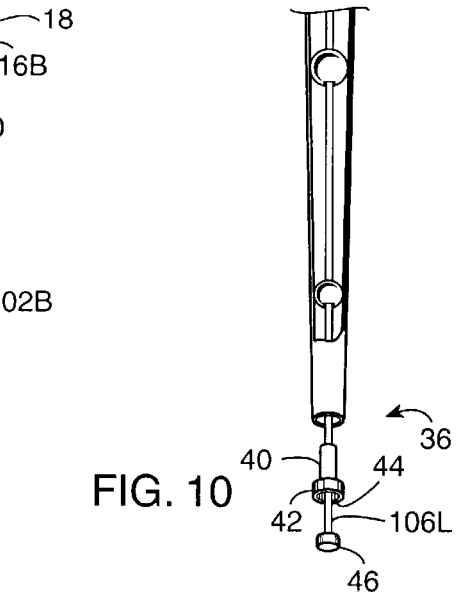
FIG. 10 is an exploded perspective view of the FIGS. 8, 9 lower wire-end retainer assembly, and a partial sectional view of the shaft lower portion.

Referring to FIGS. 9 and 10, lower wire-end retainer assembly 36 includes a generally cylindrical sleeve 40 extending in a generally cylindrical flange 42, the sleeve and flange having therethrough a common bore 44. A generally circular ring 46 is closely received within the flange. After inserting wire-end 106L through the sleeve and into the ring and flange, the wire-end is rigidly attached to the retainer assembly by crimping the ring which, with the wire under tension, is disposed within the flange and constrained upwardly by the relatively narrow diameter sleeve. Flange 42 is rigidly attached to inner wall 26W of lower shaft portion 26 at end 26E, thereby providing additional structural integrity to the shaft-clubhead juncture.

Figure 12:
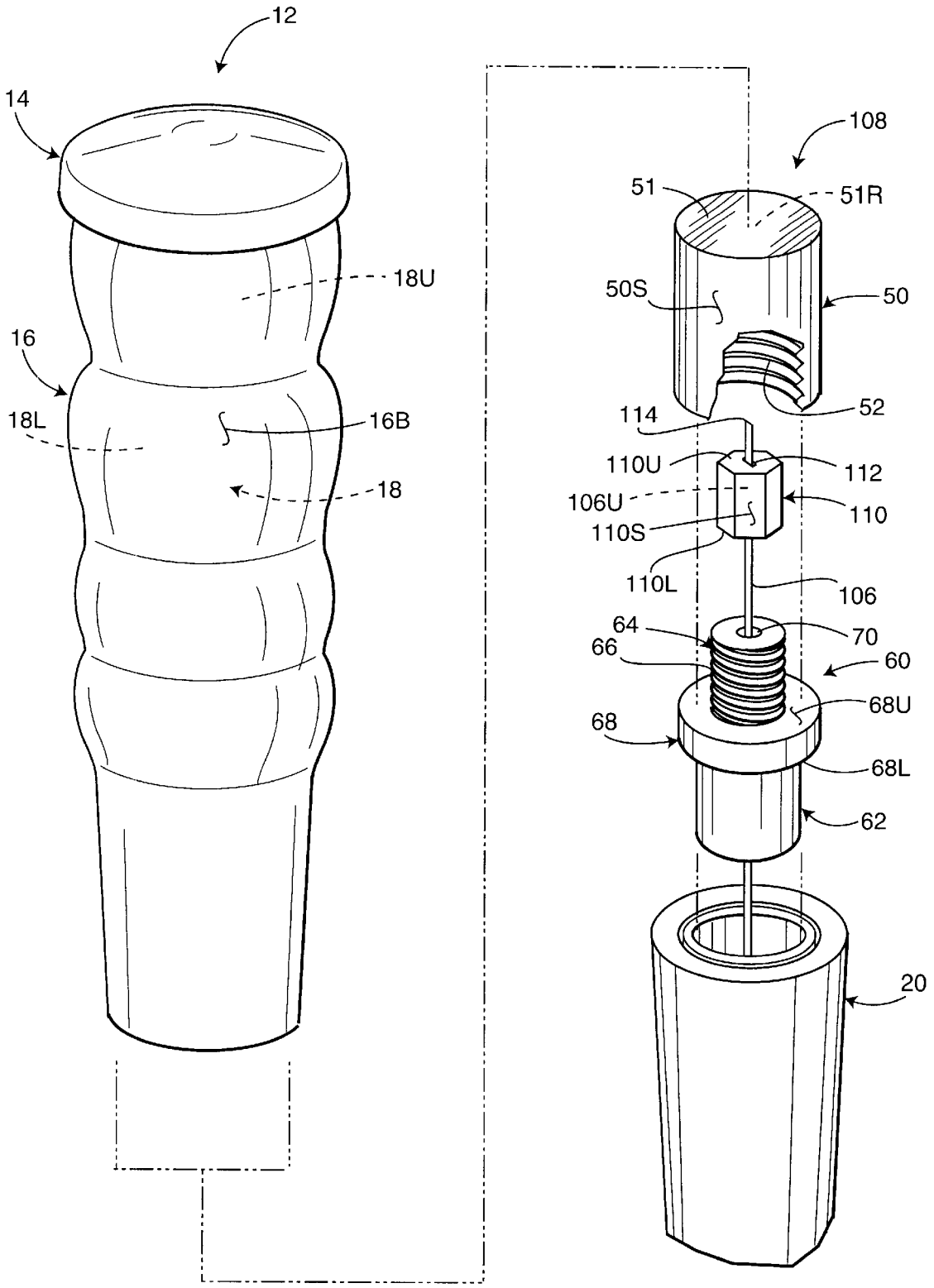
FIG. 12 is an exploded perspective and partial sectional view of the FIG. 1 club handle and FIG. 8 upper wire-end retainer assembly. The assembly includes a cap member, a wire-end clamping member, and a tension support member having a cylindrical lower portion received within the shaft, an upper threaded portion, and a flange disposed between the lower and upper portions.

Referring to FIGS. 12 and 13, the upper wire-end retainer assembly 108 includes a cap member 50 having a top portion 51 with a central inner recess 51R, an inner thread 52, and a generally cylindrical: outer-surface 50S, and a hexagonal-shaped wire-end clamping member 110 having opposed generally planar upper and lower ends 110U, 110L, respectively, and an outer: surface 110S, and a longitudinal rectangular bore 112 therethrough whose cross-section dimensions are initially slightly larger than the cross-section dimensions of wire 106. Members 110 and 54 are identical except for the difference in bore shape. Assembly 108 further includes a tension support member 60 having a cylindrical lower portion 62 closely received within shaft upper portion 20, a generally cylindrical upper portion 64 having an outer thread 66, and an annular flange 68 with opposed generally planar upper and lower surfaces 68U, 68L, respectively, and a generally circular perimeter surface 68S, the flange 68 attached to and disposed between lower portion 62 and upper portion 64. Portions 62, 64 and flange 68 each have therethrough a circular bore 70 whose axis is along the longitudinal axis. After first attaching wire-end 106L to retainer assembly 36, wire-end 106U is rigidly attached to assembly 108 by positioning clamping member 110 on top of upper portion 64 and aligning bore 112 with the bores 104 after tension support member lower portion 62 is inserted into shaft upper portion 20, threading wire-end 106U through bore 112 so that a tip 114 protrudes, applying a predetermined longitudinal tensile force at tip 114 to create a desired tension in the wire, and then radially compressing member 110 thereby shrinking bore 112 so that wire-end 106U is tightly secured within member 110. Cap member 50 is then connected to upper portion 64 by engaging threads 52 and 66, the tip 114 being received within recess 51R.

The orientation of tape-shaped wire 106 in a plane parallel to the plane of the clubface enables the shaft central portion 22 to flex as in the first embodiment. As in the first embodiment, the amount of tension in wire 106 is selected to be in a range from about 30 pounds to about 400 pounds. As in the first embodiment, preferably, the wire tension in a highly flexible shaft is about 400 pounds, the tension for a shaft which is neither very flexible nor very stiff is about 175 pounds, and the tension for a shaft which has a stiff action is about 30 pounds:

What is claimed is:

1. A golf club comprising:

a handle with a cavity having an upper portion and a lower portion;

a hollow shaft upper portion terminating in an upper end closely received within the cavity lower portion and symmetric about a longitudinal axis;

a hollow flexible shaft portion, symmetric about said axis, attached at an upper end to the shaft upper portion and attached at a lower end to a hollow shaft lower portion symmetric about said axis, the shaft lower portion terminating in a lower end;

a cap member having an inner thread and an outer surface, said outer surface closely received within the handle cavity upper portion;

a wire-end clamping member having therethrough a longitudinal bore of a predetermined cross-section, the clamping member having opposed generally planar upper and lower ends, the clamping member radially compressible, the cap member superposed upon the compressed clamping member;

a tension support member having a generally cylindrical lower portion closely received within the shaft upper portion, a generally cylindrical upper portion having an outer thread, and an annular flange having opposed generally planar upper and lower surfaces, the flange disposed between and attached to said upper and lower portions, the flange lower surface contacting the upper end of the shaft upper portion, the cap member inner thread in threaded combination with the outer thread of said upper portion; and a metallic wire having opposed upper and lower wire-ends and disposed along said axis, the upper wire-end maintained within said clamping member, the lower wire-end attached to the lower end of the shaft lower portion, the wire maintained at a preselected constant tension.

2. A golf club comprising:

a handle having a cap portion attached to a grip portion having a generally cylindrical interior surface and a scallop-contoured, symmetrically downwardly tapering exterior surface, the cap portion and interior surface determining a generally cylindrical cavity having an upper portion and a lower portion;

a hollow inflexible, downwardly tapering shaft upper portion terminating in an upper end closely received within the cavity lower portion and symmetric about a longitudinal axis;

a hollow flexible, downwardly tapering shaft central portion, symmetric about said axis, attached at an upper end to the shaft upper portion and attached at a lower end to a hollow inflexible shaft lower portion symmetric about said axis, the shaft lower portion having an inner wall and terminating in a lower end;

an upper wire-end retainer assembly comprising a cap member having a top portion, a generally cylindrical outer surface, and an inner thread, said outer surface closely received within the handle cavity upper portion, said assembly further comprising a hexagonal-shaped wire-end clamping member having opposed generally planar upper and lower ends, an outer surface, and a longitudinal bore therethrough of a constant predetermined cross-section, the clamping member radially compressible, the cap member superposed upon the compressed clamping member, said assembly further comprising a tension support member having a generally cylindrical lower portion closely received within the shaft upper portion, a generally cylindrical upper portion having an outer thread, and an annular flange having opposed generally planar upper and lower surfaces, the flange disposed between and attached to said upper and lower portions, the flange lower surface contacting the upper end of the shaft upper portion, the cap member inner thread in threaded combination with the outer thread of said upper portion;

a lower wire-end retainer assembly comprising a generally cylindrical sleeve extending in a generally cylindrical flange, the sleeve and flange having therethrough a common bore, a ring received within the flange, the flange rigidly attached to said inner wall of the shaft lower portion at said lower end; and a metallic wire of a constant predetermined cross-section having opposed upper and lower wire-ends and disposed along said axis, the upper wire-end closely received within the bore of the wire-end clamping member, said wire-end secured within the clamping member after the clamping member is radially compressed, the lower wire-end attached to said ring of the lower wire-end retainer, the wire having a constant preselected tension.

3. The golf club of claim 2, further comprising a plurality of support members each having a bore therethrough, the bores aligned with said longitudinal axis, the wire passing through each bore.

4. The golf club of claim 3, wherein the support members are fabricated from a material having a low friction coefficient.

5. The golf club of claim 4, wherein the wire is made from a material selected from the group consisting of stainless steel, titanium, and spring-wire having a Rockwell hardness in a range of 30 to 70, and has a circular cross-section with a diameter in a range from 0.032- to 0.090-inch.

6. The golf club of claim 4, wherein the wire is made from a carbon steel having a Rockwell hardness in a range of 30 to 75, and has a circular cross-section with a diameter in a range from 0.025- to 0.090-inch.

7. The golf club of claim 4, wherein the wire is made from tungsten having a Rockwell hardness in a range of 75 to 80, and has a circular cross-section with a diameter in a range from 0.031- to 0.055-inch.

8. The golf club of claim 4, wherein the wire is made from a material selected from the group consisting of stainless steel, carbon steel, titanium, and spring-wire having a Rockwell hardness in a range of 30 to 70, and has a rectangular cross-section having a width in a range from about 0.032- to about 0.125-inch and a thickness in a range from about 0.005- to about 0.025-inch.

9. The golf club of claim 4, wherein the wire is made from tungsten having a Rockwell hardness in a range of 40 to 80, and has a rectangular cross-section having a width in a range from about 0.032- to about 0.125-inch and a thickness in a range from about 0.005- to about 0.025-inch.

10. The golf club of claim 4, wherein the preselected wire tension is in a range from about 30 pounds-weight to about. 400 pounds-weight.

* * * * *